US005117898A

United States Patent [19]

Light et al.

[11] Patent Number: 5,117,898

[45] Date of Patent: Jun. 2, 1992

[54] TEMPERATURE-RESPONSIVE COOLING SYSTEM

[75] Inventors: Gerard M. Light, Marshall; Thomas A. Gee, Allen Park, both of Mich.

[73] Assignee: Eaton Corporation, Cleveland, Ohio

[21] Appl. No.: 760,309

[22] Filed: Sep. 16, 1991

[51] Int. Cl.[5] ..... F01P 7/02

[52] U.S. Cl. ..... 165/34; 165/40; 165/41; 165/51; 165/101; 123/41.08; 123/41.12; 123/41.49; 123/41.51; 192/82 T

[58] Field of Search ..... 165/34, 39, 40, 41, 165/44, 51, 76, 101; 123/41.08, 41.12, 41.49, 41.51; 192/82 T

[56] References Cited

U.S. PATENT DOCUMENTS

| | | | |
|---|---|---|---|
| 2,351,203 | 6/1944 | Hanson | 123/41.12 |
| 2,500,472 | 3/1950 | Sohler | 123/178 |
| 4,156,408 | 5/1979 | Protze | 123/41.51 |
| 4,176,630 | 12/1979 | Elmer | 123/41.12 |
| 4,365,592 | 12/1982 | Bopp | 192/82 T |
| 4,449,486 | 5/1984 | Kin | 123/41.44 |
| 4,516,630 | 5/1985 | Yamaguchi | 123/41.57 |
| 4,727,969 | 3/1988 | Hayashi et al. | 192/82 T |
| 4,938,331 | 7/1990 | Ohmi et al. | 192/82 T |
| 5,030,865 | 7/1991 | Rockey et al. | 123/41.49 |

FOREIGN PATENT DOCUMENTS

| | | | |
|---|---|---|---|
| 744857 | 5/1943 | Fed. Rep. of Germany | 123/41.08 |
| 805231 | 5/1951 | Fed. Rep. of Germany | 123/41.08 |
| 133413 | 8/1983 | Japan | 123/41.51 |

*Primary Examiner*—John K. Ford
*Attorney, Agent, or Firm*—L. J. Kasper

[57] ABSTRACT

A cooling system is disclosed in which a radiator (21) includes a coolant outflow tank (29) having separate compartments (39,41L,41R) in series with core portions (35,37L,37R) of the radiator. A temperature-responsive fan clutch (13) is adjacent the center core portion (35) and flow through that core portion is controlled by a thermostatic valve (49) which is operated between open (FIG. 3) and closed (FIG. 4) positions in response to the temperature of coolant flowing through one of the other (37L) core portions. With the thermostatic valve closed, and no flow through the center core portion, the temperature of air passing therethrough does not rise as it normally would with the vehicle stopped. Therefor, the fan clutch remains in the disengaged condition at a time when operation in the engaged condition would be both unnecessary and somewhat objectionable to the vehicle operator.

5 Claims, 3 Drawing Sheets

TEMPERATURE-RESPONSIVE COOLING SYSTEM

BACKGROUND OF THE DISCLOSURE

The present invention relates to vehicle engine cooling systems, and more particularly, to such systems of the type including a liquid-to-air heat exchange device and a temperature-responsive fan drive for rotating a cooling fan, and drawing air through the heat exchange device.

In a typical vehicle engine cooling system of the type to which the present invention relates, the radiator includes a coolant inflow tank at the top, and a coolant outflow tank at the bottom. These tanks are arranged in such a manner that there is continuous and approximately equal flow of coolant from the top tank to the bottom tank, across the entire width of the radiator As a result, the temperature of the ambient air flowing through the radiator is typically the same across the entire width of the radiator.

Although the conventional radiator arrangement, as described above, has been considered generally satisfactory, there have been certain performance shortcomings of the conventional cooling system. As one example, when a vehicle is traveling along the road, with the fan drive disengaged, then stops such as at a traffic light, the velocity of the air flowing through the radiator decreases substantially. As a result, the temperature of the air rises, even though the temperature of the coolant has typically not risen above the temperature requiring operation of the fan drive. As the air temperature rises, the fan drive begins to operate in the engage condition, thus substantially increasing the fan noise and the engine horsepower consumed.

SUMMARY OF THE INVENTION

Accordingly, it is an object of the present invention to provide an improved vehicle engine cooling system, of the type described, in which reduction of the velocity of air through the radiator does not result in an increase of the temperature of the air flowing through the radiator, and a resultant, unnecessary engagement of the fan drive.

The above and other objects of the invention are accomplished by the provision of an improved cooling system of the type comprising a liquid-to-air heat exchange device including a heat exchange core section, a coolant inflow tank, and a coolant outflow tank. The core section is disposed in series flow relationship between the inflow tank and the outflow tank. A fan clutch is operable between an engaged condition, in response to a predetermined minimum ambient air temperature, and a disengaged condition. A thermostatic valve assembly is operable between a closed position blocking coolant flow and an open position permitting coolant flow, in response to a predetermined maximum coolant temperature.

The improved cooling system is characterized by the coolant outflow tank comprising a first compartment and second compartment, and manifold means interconnecting the compartments downstream thereof. The heat exchange core section comprises a first core portion in series flow relationship with the first compartment and a second core portion in series flow relationship with the second compartment. The thermostatic valve assembly is operable to control coolant flow through the first core portion, in response to sensed coolant temperature of coolant flowing through the second core portion. The fan clutch is disposed axially adjacent the first core portion, and is responsive to the temperature of air flowing therethrough, whereby, when the coolant flowing through the second core portion is below the predetermined maximum coolant temperature, the thermostatic valve assembly is in the closed position blocking coolant flow through the first core portion, causing the ambient air temperature of the air flowing through the first core portion to drop below the predetermined minimum ambient air temperature, and causing the fan clutch to operate in the disengaged position.

DESCRIPTION OF THE PREFERRED EMBODIMENT

Figure 1:
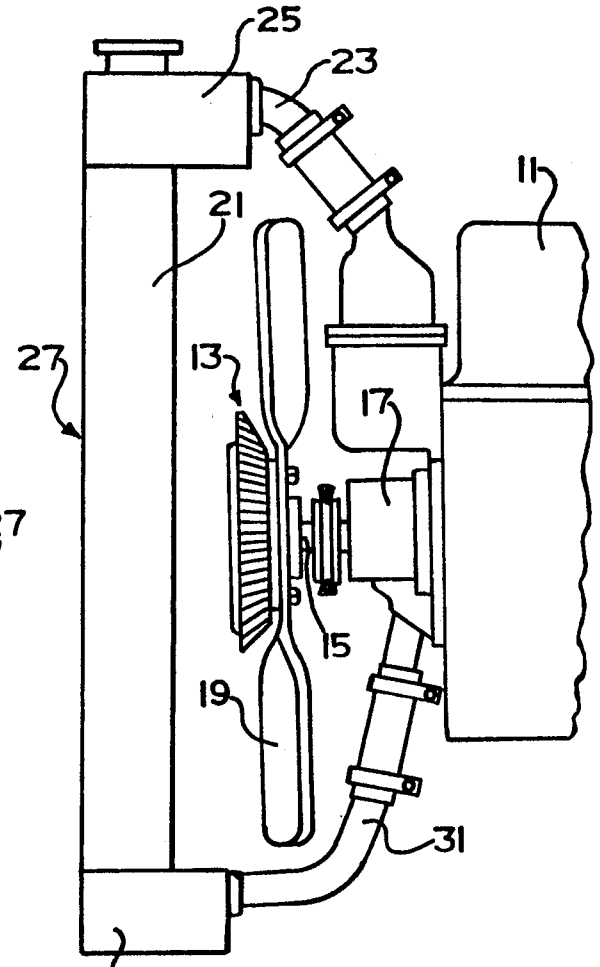
FIG. 1 is a somewhat schematic side view of a prior art vehicle cooling system of the general type with which the present invention may be utilized.

Referring now to the drawings, which are not intended to limit the present invention, FIG. 1 illustrates a vehicle engine 11 driving a fan clutch 13 which is mounted on an input shaft 15, extending from a water pump 17. Mounted on the fan clutch 13, and rotated thereby, is a cooling fan 19.

The fan clutch 13 and cooling fan 19 are disposed axially between the engine 11 and a radiator 21. In a typical cooling system, as is well known to those skilled in the art, there would be a fan shroud attached to the radiator 21 and surrounding the cooling fan 19, to increase the efficiency of air movement by the fan. However, such a shroud forms no part of the present invention, and has been omitted herein to simplify the illustration of the cooling system. In a known manner, a cooling conduit 23 communicates coolant from the engine 11 to a coolant inflow tank 25 ("top tank"). After the coolant flows through a main core section 27 it enters a coolant outflow tank 29 ("bottom tank") from where it is communicated by means of a coolant conduit 31 back to the engine 11.

Figure 2:
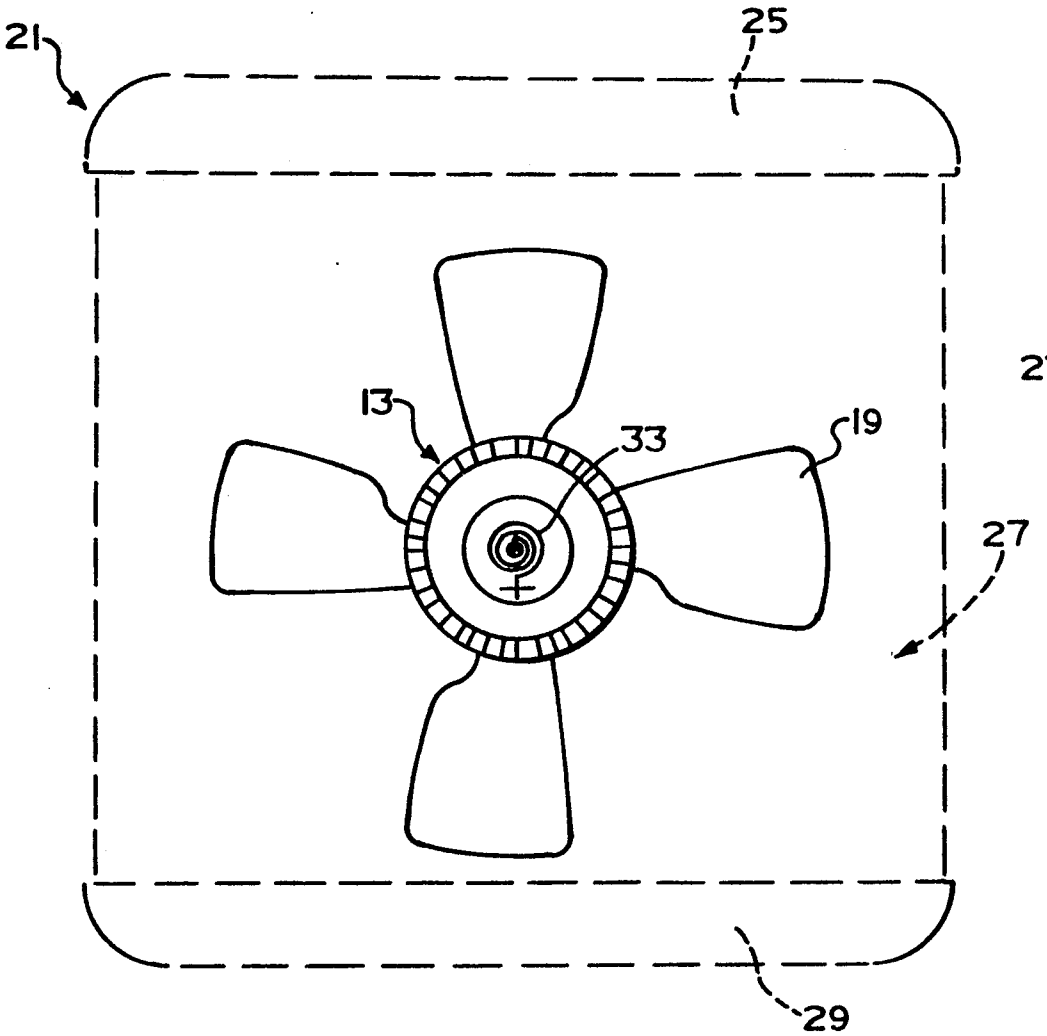
FIG. 2 is a somewhat schematic, front plan view of the fan clutch and fan included in the system shown in FIG. 1, with the location of the radiator being indicated in dashed lines.

Referring now to FIG. 2, the fan clutch 13 is preferably a viscous fan drive of the type sold by the assignee of the present invention, and is generally of the type illustrated and described in greater detail in U.S. Pat. No. 3,055,473, assigned to the assignee of the present invention. As is well known to those skilled in the art, such viscous fan drives typically include a bimetallic temperature sensing element 33 which senses ambient air temperature (i.e., the temperature of the air immediately forward of the bimetal element 33) and causes the fan drive to operate in a disengaged condition when the ambient air temperature is below a predetermined temperature, and to operate in an engaged condition when the ambient air temperature is above the predetermined temperature. As is also well known to those skilled in the art, many viscous fan drives in commercial usage are of the "modulating" type. A modulating viscous fan drive does not go immediately from the disengaged condition to the engaged condition at a predetermined ambient air temperature, but instead, begins to engage at a lower ambient air temperature (e.g., 180° F.), and gradually increases its engagement with increasing ambient temperature, until it is fully engaged at an upper ambient air temperature (e.g., 205° F.). Preferably, for purposes of the present invention, the "predetermined minimum ambient air temperature" would refer to the lower temperature limit, in the case of a modulating fan drive, or would, of course, refer to the predetermined transition temperature in the case of an ON-OFF fan drive.

Figure 4:
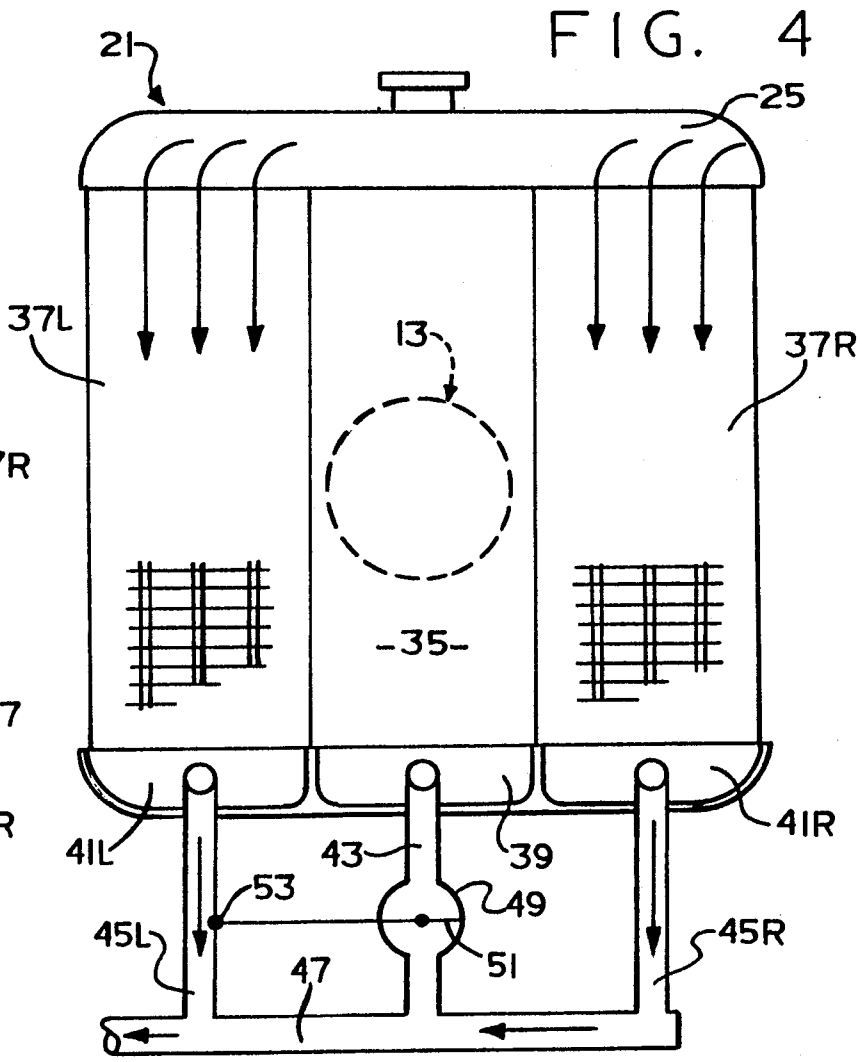
FIGS. 3 and 4 are somewhat schematic, front plan views of the cooling system of the present invention, in its two different operating modes.
Figure 3:
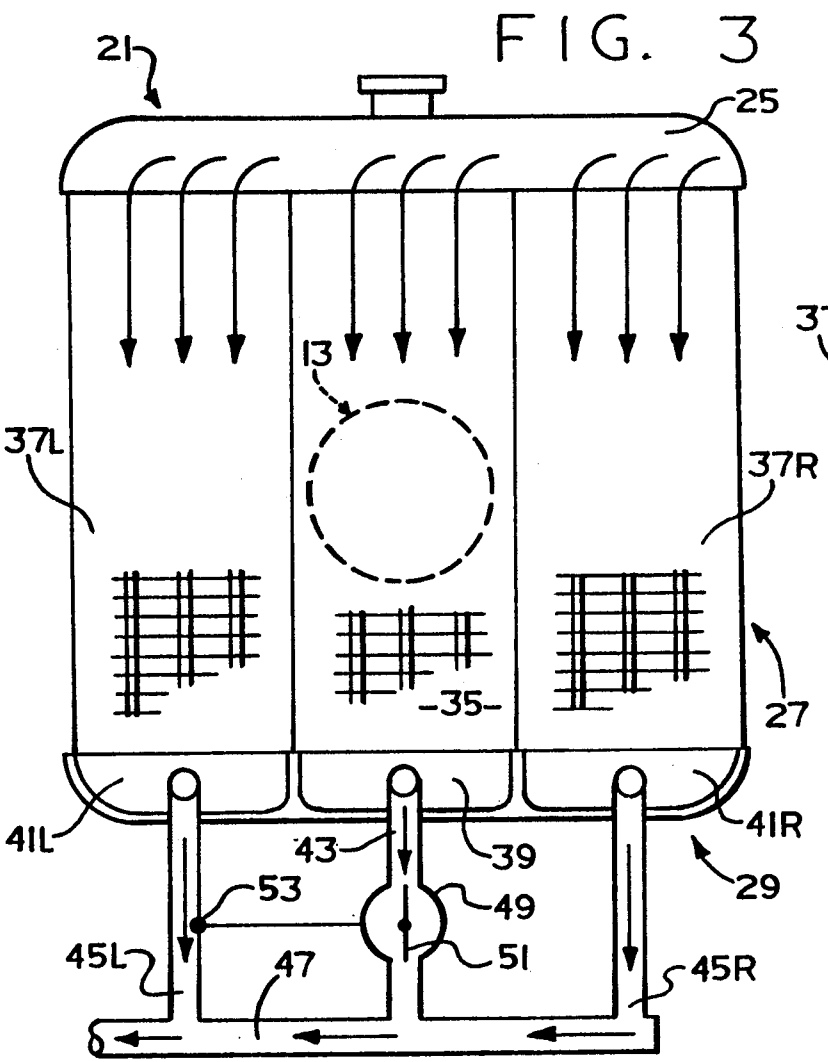

In accordance with one aspect of the present invention, and as is best shown in FIGS. 3 and 4, the core section 27 of the radiator 21 comprises a central core portion 35, and a pair of side core portions 37L and 37R. The fan clutch 13 is axially aligned with the central core portion 35, and the width of the core portion 35 is illustrated as being approximately equal to the diameter of the fan clutch 13. However, it should be understood that no particular size or dimensional relationship is essential to the present invention. It is essential only that the fan clutch be located, relative to the central core portion 35, such that the bimetal element 33 is responsive primarily to the temperature of the air flowing through the central core portion 35. Furthermore, it is not actually essential that the fan clutch be located with a central core portion, with a side core portion being disposed on either side thereof. In theory, the core section 27 could be divided into only two core portions, with the fan clutch being aligned with one core portion. However, in view of the need to have the cooling fan 19 coextensive with as large a portion of the core section 27 as possible, the arrangement shown herein, with the fan clutch 13 aligned with a central core portion 35, seems to be the most desirable and efficient arrangement.

Referring still to FIGS. 3 and 4, it is shown schematically that the coolant inflow tank 25 comprises one continuous tank, in open communication with both the central core portion 35 and each of the side core portions 37L and 37R. However, as is also shown, the coolant outflow tank 29 comprises three distinct compartments, which are blocked from communication with each other. The central core portion 35 empties into a central compartment 39, while the side core portions 37L and 37R empty into side compartments 41L and 41R, respectively, for reasons which will be described in greater detail subsequently. For reasons which will become apparent, it would be acceptable to permit the side compartments 41L and 41R to communicate with each other, as long as neither of those side compartments is able to communicate with the central compartment 39.

In a typical, prior art cooling system, there would be only a single coolant conduit extending out of the coolant outflow tank 29, such as the coolant conduit 31 shown in FIG. 1. However, in accordance with one aspect of the present invention, there is a vertical coolant conduit 43 extending out of the central compartment 39 and a pair of vertical coolant conduits 45L and 45R extending out of the side compartments 41L and 41R, respectively. The vertical conduits 43, 45L, and 45R, are all connected to a manifold 47, the function of which would be to return the coolant to the engine 11, in the manner described in connection with FIG. 1. It should be understood by those skilled in the art that the arrangement of compartments and conduits shown in FIGS. 3 and 4 is intended to be somewhat schematic, illustrating the general concept and function, and is not necessarily intended to represent an actual physical embodiment. In an actual embodiment, it is possible that communication among the various compartments, downstream thereof, could be accomplished, not by means of separate conduits, but by forming the individual compartments out of liners or inserts within the bottom tank 29.

Interposed in the vertical conduit 43 is a temperature-responsive (also referred to hereinafter as "thermostatic") valve assembly 49, which is illustrated herein schematically for purposes of simplicity as a butterfly-type valve assembly including a pivotable butterfly valve member 51. Operation of the valve assembly 49 between an open position (as shown in FIG. 3) and a closed position (as shown in FIG. 4) is in response to a temperature sensing member 53. The sensor member 53 is operably associated with the vertical coolant conduit 45L (or with the side core portion 37L or side compartment 41L) in any suitable manner such that the operation of the valve assembly 49 is in response to the temperature of the coolant flowing through the conduit 45L. Obviously, the sensor member 53 could also be associated with the side core portion 37R, or side compartment 41R, or the coolant conduit 45R.

During normal, light load operation of the vehicle and the cooling system, there is sufficient cooling capacity to keep the coolant in the radiator below a predetermined maximum coolant temperature. This is especially true during cool or cold weather. Referring now to FIG. 3, there is illustrated an operating condition ("hot operation") which would typically exist during very hot weather, with the vehicle moving slowly in traffic, and perhaps also pulling a load of some sort (e.g., a trailer, etc.). During typical hot operation, the coolant entering the inflow tank 25 would be at about 230° F. (for many gasoline engines). As is illustrated by the flow arrows in FIG. 3, coolant would flow from the inflow tank 25 down through all of the core tubes, transferring heat from the coolant to the fins, then to the ambient air flowing through the radiator, in a manner well known to those skilled in the art. As the coolant reaches the various compartments in the outflow tank 29, it is at about 210° F., and this temperature is sensed by the sensing member 53. Assuming, for purposes of explanation only, that the 210° F. coolant temperature is above the predetermined actuation temperature for the thermostatic valve assembly 49. The valve member 51 remains in the open position shown in FIG. 3, such that coolant can flow through the coolant conduit 43, as well as through the conduits 45L and 45R. During hot operation, therefor, the cooling system of the present invention operates effectively in the same manner as a conventional cooling system.

Referring now to FIG. 4, there will be described a different operating mode for the cooling system of the present invention. This mode of operation would typically occur when the vehicle is traveling along the road, and ram air provides sufficient cooling, but could also occur advantageously in situations such as "stop and go" driving. When the vehicle has been traveling along a road, with the fan clutch 13 disengaged, then stops (such as at a traffic light) for a short time, it has been a common occurrence for the temperature of the air flowing through the radiator to rise sufficiently (in the absence of ram air) to cause engagement of the fan clutch 13, even though the coolant temperature is sufficiently low. The result is an increase in fan noise (which may be quite noticeable and objectionable to the vehicle operator when the vehicle is accelerated from the stop). Also objectionable is the increased horsepower and fuel consumed by the cooling fan 19.

The cooling system of the present invention overcomes this tendency for unnecessary engagement of the fan clutch 13. Typically, in the situation just described, the coolant flowing into the inflow tank 25 is at about 205° F. As the coolant flows through the side core portions 37L and 37R, into the side compartments 41L and 41R, it is cooled to about 195° F., which is below the temperature required to open the thermostatic valve assembly 49. Therefor, as is shown in FIG. 4, the valve member 51 moves to the closed, horizontal position, blocking coolant flow through the central core portion 35, and through the central compartment 39 and coolant conduit 43.

With no coolant flow through the central core portion 35, the temperature of the coolant in that portion decreases and approaches that of the ambient air which, in the subject embodiment, is well below the predetermined minimum of about 180° F. which is just below the predetermined minimum ambient air temperature needed to cause engagement of the fan clutch 13. Therefor, the fan clutch 13 will remain in its disengaged condition.

It should be apparent to those skilled in the art that the specific temperatures and temperature ranges discussed hereinabove are merely examples, given for purposes of illustration of the operation of the invention. The invention is not limited to any particular temperatures or temperature ranges.

ALTERNATIVE EMBODIMENT

Figure 5:
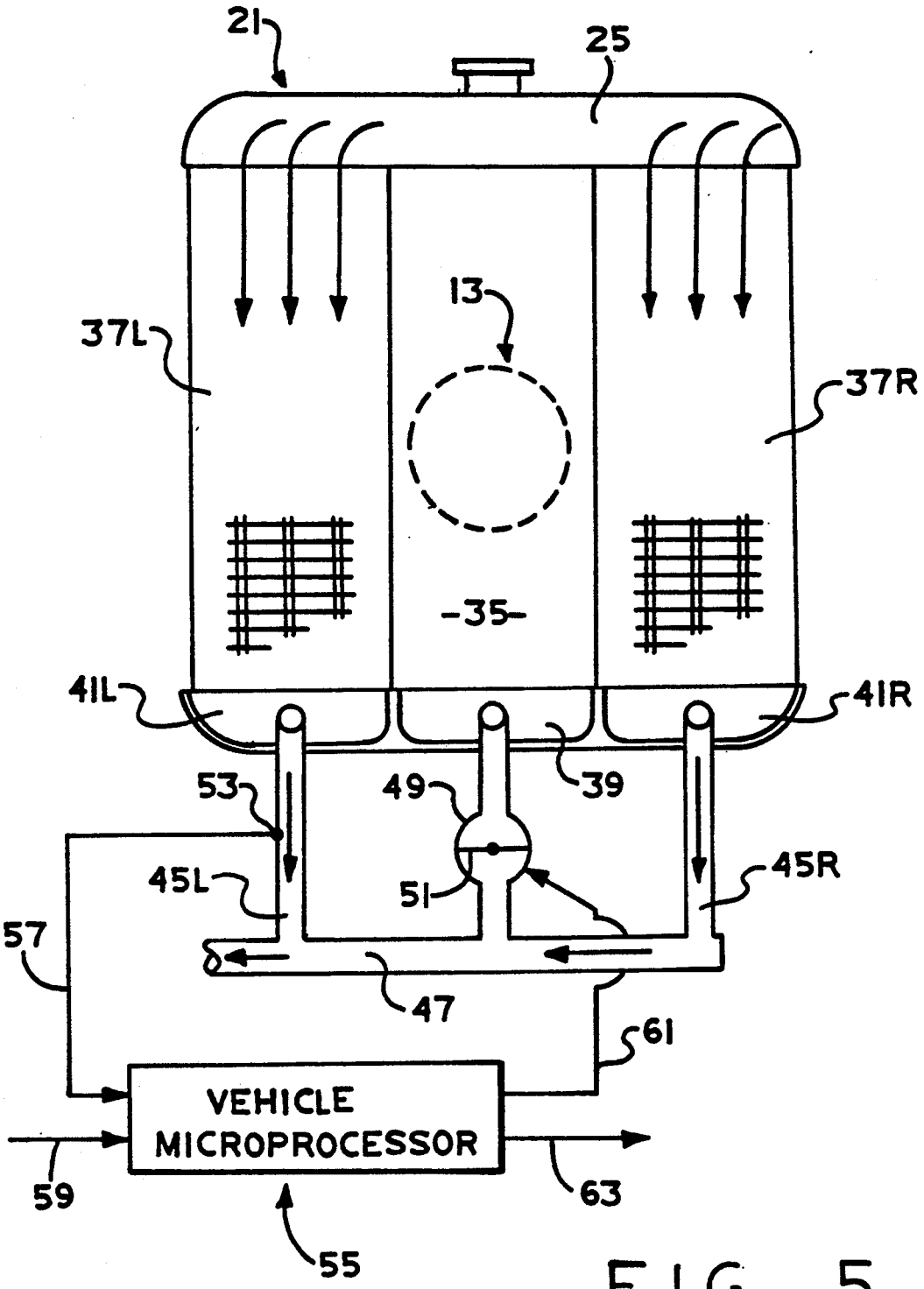
FIG. 5 is a somewhat schematic, front plan view of a cooling system made in accordance with an alternative embodiment of the present invention.

Referring now to FIG. 5, there is illustrated an alternative embodiment of the present invention in which the temperature-sensing member 53 does not directly control the position of the valve member 51 in the valve assembly 49. Instead, in the embodiment of FIG. 5, the cooling system includes a vehicle microprocessor, generally designated 55. One of the inputs to the vehicle microprocessor 55 is the temperature of the coolant in the conduit 45L, as sensed by the sensing member 53. This temperature is communicated to the microprocessor 55 by means of a signal line 57. At the same time, there are other inputs to the microprocessor, as is schematically indicated by the signal line 59. Examples of these other inputs would be vehicle parameters such as the air conditioning compressor pressure, the vehicle throttle position, or various vehicle safety and/or failure diagnostic signals.

Based on all of the inputs, the vehicle microprocessor 55 generates a valve actuation signal and transmits the signal by means of line 61 to the valve member 51, thereby putting the valve member 51 in the proper position, ultimately to control the engagement or disengagement of the fan clutch 13, as was described previously. As is well known to those skilled in the art, there are various other outputs from the vehicle microprocessor, as is indicated schematically by a signal line 63. Examples of these other outputs represented by the signal line 63 would be a fuel flow command and an ignition timing command.

The present invention has been illustrated in connection with an embodiment in which the coolant outflow tank 29 is divided into various compartments. However, it should be understood that the present invention is not so limited. The invention could also be used by dividing the inflow tank 25 into various compartments and utilizing a thermostatic valve at the top of the central core portion 35 to prevent flow therethrough, in response to the temperature of the coolant in one of the side compartments. However, there is typically more space available for additional structure in the outflow tank 29, and therefor, this particular embodiment has been illustrated.

Therefor, it may be seen that the present invention provides a cooling system in which operation of the fan clutch 13 is more nearly responsive to coolant temperature (i.e., the temperature of the coolant in the coolant conduit 45L), which is one of the primary objectives of many of the more complex and expensive emote temperature-sensing cooling systems. The present invention accomplishes nearly the same result, without the addition of some sort of pneumatic or electronic actuator to the fan clutch 13. Instead, operation of the fan clutch is controlled indirectly by "controlling" the temperature of the air flowing through the center core portion 35, in response to the temperature of the coolant flowing through the core portions 37L and 37R.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A cooling system of the type comprising a liquid-to-air heat exchange device including a heat exchange core section, a coolant inflow tank, and a coolant outflow tank, said core section being disposed in series flow relationship between said inflow tank and said outflow tank; a fan clutch operable between an engaged condition, in response to a predetermined minimum ambient air temperature, and a disengaged condition; and a thermostatic valve assembly operable between a closed position (FIG. 4) blocking coolant flow and an open position (FIG. 3) permitting coolant flow, in response to a predetermined maximum coolant temperature, characterized by:

(a) one of said coolant inflow tank and said coolant outflow tank comprising a first compartment and a second compartment, and means interconnecting said compartments downstream thereof;

(b) said heat exchange core section comprising a first core portion in series flow relationship with said first compartment, and a second core portion in series flow relationship with said second compartment;

(c) said thermostatic valve assembly being operable to control coolant flow through said first core portion, in response to sensed coolant temperature of coolant flowing through said second core portion; and (d) said fan clutch being disposed axially adjacent said first core portion, and responsive to the temperature of air flowing therethrough, wherein, when the coolant flowing through said second core portion is below said predetermined maximum coolant temperature, said thermostatic valve assembly is in said closed position (FIG. 4) blocking coolant flow through said first core portion, causing the ambient air temperature of the air flowing through said first core portion to drop below said predetermined minimum ambient air temperature, and causing said fan clutch to operate in said disengaged condition.

2. A cooling system as claimed in claim 1, characterized by said first core portion comprising a central core portion and said second core portion comprising a pair of side core portions oppositely disposed about said central core portion.

3. A cooling system as claimed in claim 2, characterized by said first compartment comprising a central compartment, and said second compartment comprising a pair of side compartments oppositely disposed about said central compartment.

4. A cooling system as claimed in claim 1, characterized by said coolant outflow tank comprising said first compartment and said second compartment, and said means interconnecting said compartments downstream comprising manifold means disposed external to said compartments.

5. A cooling system of the type comprising a liquid-to-air heat exchange device including a heat exchange core section, a coolant inflow tank, and a coolant outflow tank, said core section being disposed in series flow relationship between said inflow tank and said outflow tank; a fan clutch operable between an engaged condition, in response to a predetermined minimum ambient air temperature, and a disengaged condition; and a thermostatic valve assembly operable between a closed position (FIG. 4) blocking coolant flow and an open position (FIG. 3) permitting coolant flow, in response to a predetermined maximum coolant temperature, characterized by:

(a) one of said coolant inflow tank and said coolant outflow tank comprising a first compartment and a second compartment, and means interconnecting said compartments downstream thereof;

(b) said heat exchange core section comprising a first core portion in series flow relationship with said first compartment, and a second core portion in series flow relationship with said second compartment;

(c) said thermostatic valve assembly being operable to control coolant flow through said first core portion, in response to an actuation signal;

(d) control logic means operable in response to at least one vehicle input signal to generate said actuation signal; and, (e) said fan clutch being disposed axially adjacent said first core portion, and responsive to the temperature of air flowing therethrough, wherein, when said actuation signal indicates less need for cooling, said thermostatic valve assembly is in said closed position (FIG. 4) blocking coolant flow through said first core portion, causing the ambient air temperature of the air flowing through said first core portion to drop below said predetermined minimum ambient air temperature, and causing said fan clutch to operate in said disengaged condition.

* * * * *